United States Patent [19]

Johnson

[11] 4,232,732

[45] Nov. 11, 1980

[54] HEAT ARRESTER BOOT FOR ROOM STOVE

[76] Inventor: Albert V. Johnson, R.R. 1, Box 87, Erhard, Minn. 56534

[21] Appl. No.: 899,356

[22] Filed: Apr. 24, 1978

[51] Int. Cl.[3] ..... F28F 3/08

[52] U.S. Cl. ..... 165/77; 126/110 B; 165/121

[58] Field of Search ..... 126/117, 118, 121, 110, 126/110 A, 110 AA, 110 B; 165/96, 100–103, DIG. 2, 76, 77; 237/55

[56] References Cited

U.S. PATENT DOCUMENTS

| | | | |
|---|---|---|---|
| 211,687 | 1/1979 | Baldwin | 126/117 |
| 937,265 | 10/1909 | Philipski | 126/110 A |
| 2,882,023 | 4/1959 | Rizzo | 165/39 |

FOREIGN PATENT DOCUMENTS

| | | | |
|---|---|---|---|
| 251281 | 10/1947 | Switzerland | 165/96 |

*Primary Examiner*—Samuel Scott
*Assistant Examiner*—Theophil W. Streule, Jr.
*Attorney, Agent, or Firm*—Merchant, Gould, Smith, Edell, Welter & Schmidt

[57] ABSTRACT

An improved heat arrester boot interposed between sections of a smoke pipe or like conduit means for extracting heat from waste gases and smoke. The heat arrester boot includes an inner core which can be easily removed for the purposes of cleaning when coated with creosote and the like while the remainder of the heat arrester boot remains in place.

7 Claims, 7 Drawing Figures

HEAT ARRESTER BOOT FOR ROOM STOVE

BACKGROUND OF THE INVENTION

This invention relates to an improved heat arrester boot, specifically a heat arrester boot which may be easily cleaned. It is known in the art to pass heated gases and smoke through a plurality of fixed cylindrical tubes to heat the air surrounding the tubes as exemplified by the patents to Faunce U.S. Pat. No. 2,343,542 and Leonard U.S. Pat. No. 417,874. However, the insides of the cylindrical tubes often become coated with creosote and the like and must, therefore, be periodically cleaned in order to maintain a high degree of efficiency in conducting heat. The patent to Leonard supra at lines 49–54 and Smith U.S. Pat. No. 349,534 at lines 53–68 disclose devices which may be disassembled for the purpose of cleaning the cylindrical tubes. However, these devices are inconvenient in that either the cylindrical tubes cannot be removed as a unit as in the patent to Smith supra or require removal of a significant portion of the heating structure as in the patent to Leonard supra in order to clean the tubes. Furthermore, these devices generally must be disconnected from the pipes to which they are connected in order to clean the tubes.

SUMMARY OF THE INVENTION

The instant invention discloses an improved heat arrester boot which may be interposed between portions of a smoke pipe for extracting heat from waste gases of combustion and smoke flowing through the smoke pipe. The heat arrester boot has a portion which can be easily removed for cleaning, while other portions of the boot can remain in place between portions of the smoke pipe which are hereinafter termed an inlet pipe and an outlet pipe. The heat arrester boot generally comprises a bottom inlet chamber through which the waste gases and smoke enter, a top outlet chamber from which the waste gases and smoke exit and, an at least partially closed central chamber between the bottom inlet chamber and the top outlet chamber. The heat arrester boot further includes the improvement of a removable inner core positioned within the central chamber. The inner core includes at least one passageway connecting top and bottom ends thereof through which the heated waste gases and smoke pass from the inlet chamber to the outlet chamber so as to heat the air surrounding the inner core.

Instead of being partially closed, the central chamber can include the further improvement of a portion which is movable so as to form an opening when it is desired to remove the inner core. Furthermore, the movable portion can be configured and movable outwardly from the inner core so as to vary the flow of heated air directed against it. Also, means can be provided for mounting the outlet chamber for movement towards and away from the central chamber. Moreover, means can be provided for causing the top outlet chamber to move toward or away from the central chamber along a path defined by the means mounting the outlet chamber.

Various advantages and features of novelty which characterize the instant invention are pointed out with particularity in the claims annexed hereto and forming a part hereof. However, for a better understanding of the instant invention, its advantages, and objects obtained by its use, reference should be had to the drawing which forms a part hereof, and to the accompanying descriptive matter in which there are illustrated certain preferred embodiments of the instant invention.

DESCRIPTION OF THE PREFERRED EMBODIMENT

Figure 1:
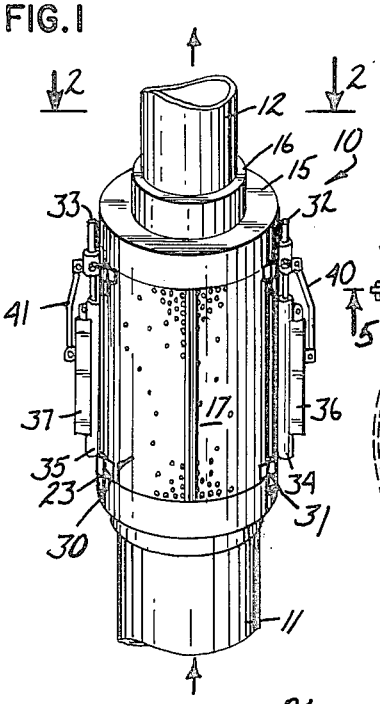
FIG. 1 is a fragmentary view in perspective showing an arrester boot according to the instant invention in position to receive waste gases and smoke.
Figure 2:
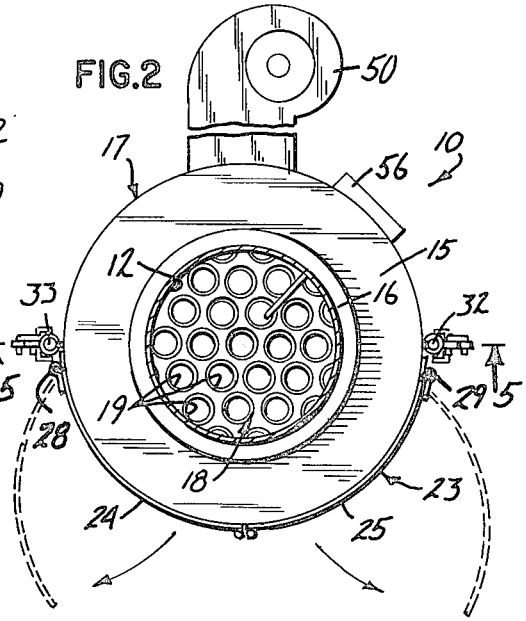
FIG. 2 is a view partly in top plan and partly in section taken along line 2—2 of FIG. 1.
Figure 3:
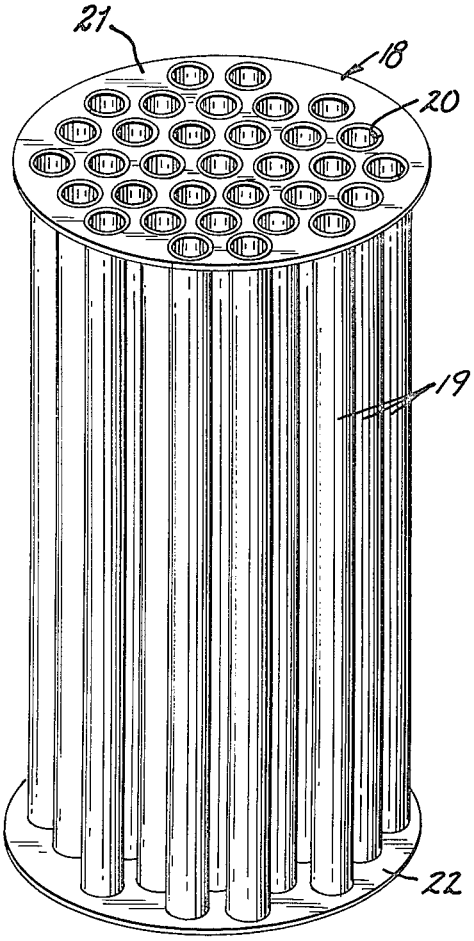
FIG. 3 is an enlarged view in perspective of the removable inner core of the heat arrester boot.
Figure 4:
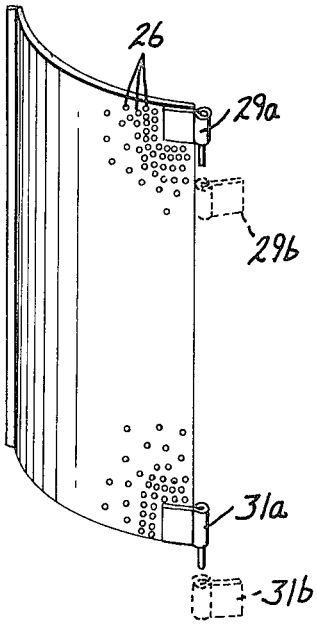
FIG. 4 is an enlarged view in perspective of part of the movable portion of the central chamber of the heat arrester boot.
Figure 5:
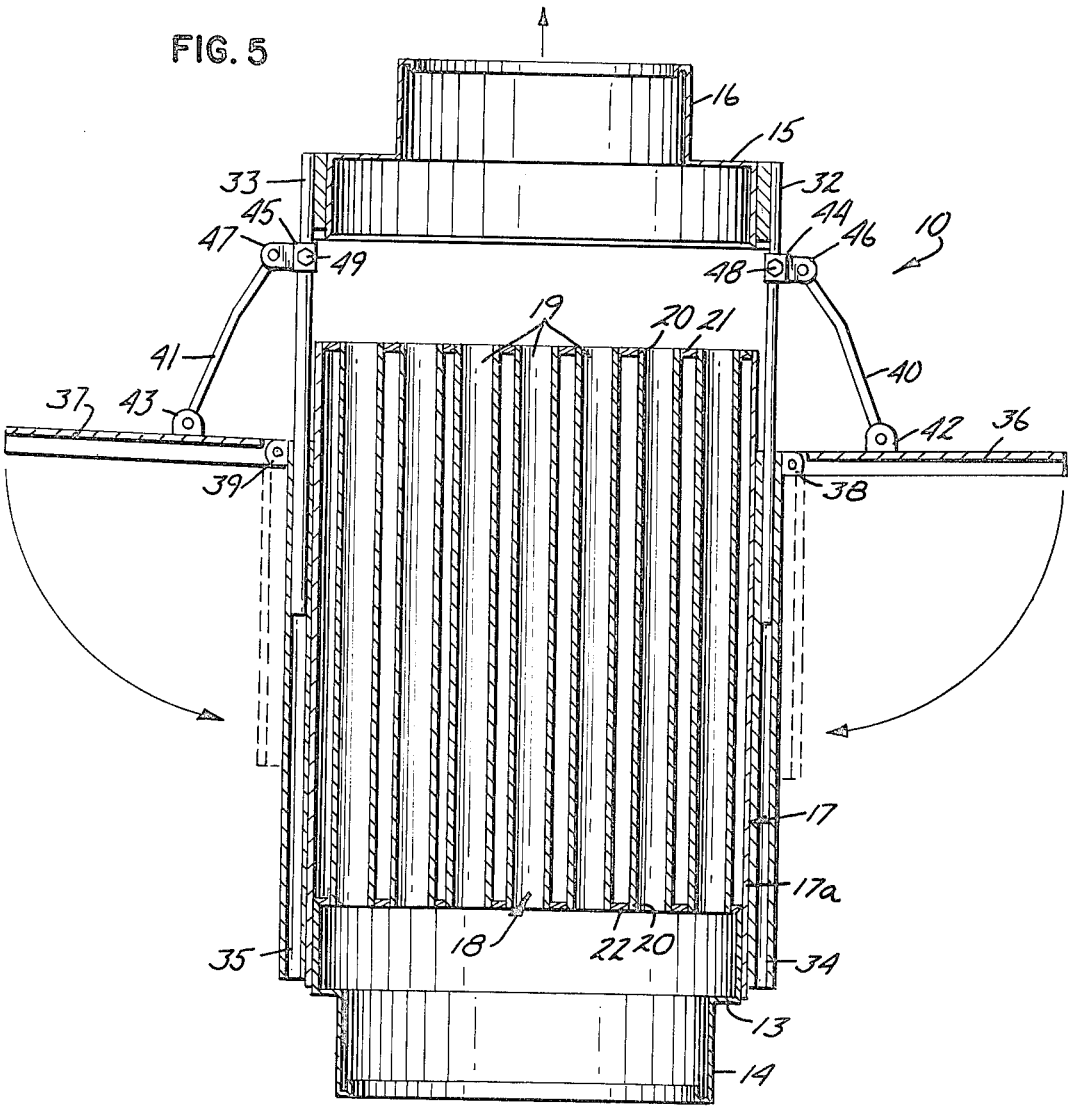
FIG. 5 is a sectional view taken along line 5—5 of FIG. 2.

As shown in FIG. 1, a heat arrester boot 10 is positioned between an inlet pipe 11 and an outlet pipe 12 through which hot waste gases and smoke move in a direction indicated by the arrows. Although not shown, it can be assumed that the inlet pipe 11 extends from a stove, furnace, or other fuel burning device, and that the outlet pipe 12 extends to a chimney or like conduit. As particularly shown in FIG. 5, the heat arrester boot 10 includes a bottom inlet chamber 13 having an entrance port 14, a top outlet chamber 15 having an exit port 16, and a generally cylindrical central chamber 17 between the top outlet chamber 15 and the bottom inlet chamber 13. Positioned within the central chamber 17 is a removable inner core 18 more particularly shown in FIG. 3. The inner core 18 includes a plurality of hollow elements such as cylindrical tubes 19 in spaced generally parallel relationship to one another, the upper ends of these cylindrical tubes being fixed in apertures 20 in the top end of the inner core such as circular top plate 21, the lower ends being fixed in similar apertures 20 in the bottom end of the inner core such as circular bottom plate 22. As shown in FIGS. 1, 2 and 5, the central chamber includes a partially closed portion such as fixed semicylindrical chamber wall **17*a* mounted on the inlet chamber and a movable semicylindrical wall portion 23 which comprises a cross-sectionally arcuate left-hand door member 24 and a similar right-hand door member 25. Each of the door members can have formed therein a multiplicity of perforations 26. Door members 24 and 25 are pivotally mounted on or connected to opposite horizontally spaced ends of chamber wall 17*a* by suitable means such as upper hinges 28 and 29, lower hinges 30 and 31 respectively so that either the left-hand door member 24 or the the right-hand door member 25, or both thereof, may be pivoted outwardly and open about generally vertical axes, as shown by dotted lines and arcuate arrows in FIG. 2, in order to direct the flow of air coming out of central chamber 17. As shown in FIG. 4, the hinges can be in the form of portions 29*a* and 31*a* attached to the door member releaseably insertable in portions 29*b* and 31*b* attached to chamber wall 17*a*** so that the door members can be removed for the purpose of cleaning, etc.

As particularly shown in FIG. 5, rails 32, 33 are carried by, mounted on or attached to chamber 15 and slidably move within receiving cylinders 34, 35 carried by, mounted on or attached to chamber wall 17*a*. A pair of handles 36, 37 are pivotally connected to the receiving cylinders 34, 35 at ears 38, 39. A pair of links 40, 41 are each pivotally connected at one end to a respective handle 36, 37 at ears 42, 43. The other ends of the links 40, 41 are pivotally connected to anchoring members 44, 45 respectively at ears 46, 47. The anchoring members 44, 45 are fixed in place on the rails 32, 33 by suitable means such as bolts 48, 49 so that the anchoring members 44, 45 can be adjustably positioned at various places along the rails 32, 33. When the handles 36, 37 are swung outwardly and upwardly as shown by the arcuate arrows in FIG. 5, the top outlet chamber 15 moves upwardly along the path defined by rails 32, 33 and the receiving cylinders 34, 35.

In order that the top outlet chamber 15 can be moved while the heat arrester boot 10 remains in place between pipes 11 and 12, the exit port 16 is preferably sized for at least sliding engagement with pipe 12. A collar for attaching the exit port to pipe 12 can be used if necessary to prevent the escape of smoke into the room. When the inner core is removed from the central chamber when the door members are swung open or removed, access to the inner wall surfaces of the several chambers 13, 15 and 17 is convenient for cleaning if necessary. If desired, an identical second inner core may be positioned within the central chamber while the first inner core is being cleaned.

A blower 50 is shown as being attached to the central chamber 17. As hot gases and smoke pass through the tubes 19 from the bottom chamber 13, the tubes 19 and the air within the chamber 17 become heated. By opening one or both of the door members 24, 25 and by energizing the blower 50, the heated air is circulated about the room in which the heat arrester boot is disposed. The amount of heat transferred to the room can be varied as desired by the extent to which either or both of the door members 24, 25 are open. As the waste gases and smoke move upwardly through the tubes 19, they become cooled and exit through the outlet chamber 15 and the outlet pipe 12. If desired, the door members 24, 25 can be closed so as to enhance the overall appearance of the structure with perforations 26 enabling heated air to escape from the central chamber into the room.

A temperature sensing device such as 56 can also be mounted on the top outlet chamber to automatically control the operation of blower 50, e.g., turn blower on when heated gases enter the outlet chamber and turn blower off when heated gases are no longer entering the outlet chamber.

Figure 6:
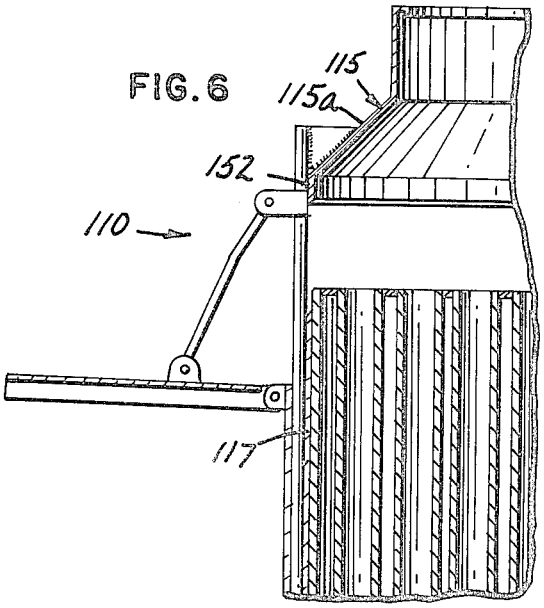
FIGS. 6 and 7 are fragmentary sectional views according to FIG. 5 of a second embodiment of the heat arrester boot.
Figure 7:
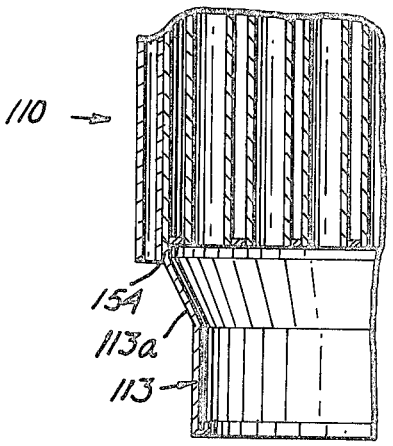

As shown in FIGS. 6 and 7, when the outlet chamber is movably mounted on the central chamber, a second embodiment 110 of the heat arrester boot according to the present invention can be utilized. As shown in FIG. 6, outlet chamber 115 is provided with a portion, such as generally circular lip 152, which is connected to a generally frusto-conical portion 115*a*.

Lip 152 is sized so as to surround the top end of the inner core when the outlet chamber is moved towards and near the top end of the central chamber. Inlet chamber 113 can also be provided with a portion, such as circular lip 154 which is connected to and extends generally upwardly from inverted generally frusto-conical portion 113*a*. Lip 154 is sized so as to receive the bottom end of the inner core so that the inner core is securely positioned within central chamber 117 when outlet chamber 115 is moved towards and near the top end of the central chamber.

Numerous characteristics and advantages of the instant invention have been set forth in the foregoing description, together with details of the structure and function of the instant invention, and the novel features thereof are pointed out in the appended claims. The disclosure, however, is illustrative only, and changes may be made in detail, especially in matters of shape, size, and arrangement of parts within the principle of the instant invention, to the full extent indicated by the broad general meaning of the terms in which the appended claims are expressed.

What is claimed:

1. A heat arrester boot for room stoves for extracting heat from waste gases and smoke comprising:

a bottom inlet chamber having an entrance port through which the waste gases and smoke enter, and a generally circular lip;

a top outlet chamber having an exit port from which the waste gases and smoke exit, and a generally circular lip;

a generally cylindrical central chamber between said inlet and outlet chambers and including a pair of cross sectionally arcuate door members to form a semi-cylindrical portion of said central chamber, and a semi-cylindrical chamber wall fixedly mounted on said inlet chamber and having opposite horizontally spaced ends, each of said door members being mounted on one of said ends of said chamber wall for outward pivotal movement about a generally vertical axis;

a pair of generally parallel rails attached to said outlet chamber;

a pair of parallel receiving cylinders attached to said chamber wall and slidably mounting said rails;

a pair of handles having first ends and second ends, said first ends being pivotally connected to said receiving cylinders;

a pair of links pivotally connected at first ends to said handles between said first and second ends thereof;

a pair of anchoring members positioned on said rails, said anchoring members being pivotally connected to second ends of said links, said handles, said links and said anchoring members cooperating to impart reversible movement to said outlet chamber along a path defined by said rails and said receiving cylinders when said handles are raised and lowered;

means for adjustably securing said anchoring members to said rails; and an inner core including a plurality of parallel spaced hollow cylindrical tubes having upper and lower ends, and generally circular top and bottom plates having a plurality of apertures formed therein for receiving said ends of said cylindrical tubes;

said lip of said inlet chamber being sized to receive said bottom plate, said lip of said outlet chamber being sized to surround said top plate when said outlet chamber is moved toward and near said central chamber.

2. A heat arrester boot according to claim 1 further comprising a blower mounted on said chamber wall for circulating ambient air into said central chamber and about said cylindrical tubes and outwardly against said door members, and means mounted on said outlet chamber for sensing the temperature therein and for controlling said blower in response thereto.

3. A heat arrester boot, for extracting heat from the waste gases of a fuel burning device, comprising in combination:

a central chamber elongated along an axis between first and second ends;

an inlet chamber secured to said central chamber at said first end thereof;

an outlet chamber;

means movably supporting said outlet chamber on said central chamber at said second end thereof;

a removable inner core member in said central chamber comprising first and second end plates, normally isolating said inlet and outlet chambers from said central chamber, and passage means interconnecting said end plates for isolatingly conducting waste gases through said central chamber from said inlet chamber to said outlet chamber;

and means enabling transverse flow of ambient air in said central chamber in heat transfer relation to said passage means, said central chamber including means affording lateral access thereinto to enable insertion and removal of said inner core with respect thereto, and said mounting means including means enabling axial relative movement of said outlet chamber, with respect to said central chamber, out of a normal position in which said outlet chamber engages said central chamber to prevent insertion and removal of said inner core with respect to said central chamber through the access affording means.

4. A heat arrester boot according to claim 3 in which said mounting means comprises a rail and a receiving tube carried one by said central chamber and one by said outlet chamber, and aligned with said axis, one of said rail and said tube extending beyond the edge of the chamber carrying it.

5. A heat arrester boot according to claim 4 including means connected to said rail and said tube for causing relative movement therebetween in a direction aligned with said axis.

6. A heat arrester boot according to claim 4 including a plurality of said rails and said receiving tubes.

7. A heat arrester boot according to claim 3 in which the access affording means comprises a door pivoted to said central chamber about an axis parallel to said axis of said chamber.

* * * * *